US011308782B1

(12) United States Patent
Stevens

(10) Patent No.: US 11,308,782 B1
(45) Date of Patent: Apr. 19, 2022

(54) NON-LETHAL INTRUDER DETERRENT AND SUPPRESSION DEVICE CAPABLE OF TEMPORARILY INCAPACITATING UNWANTED INTRUDERS

(71) Applicant: Craig C Stevens, Plano, TX (US)

(72) Inventor: Craig C Stevens, Plano, TX (US)

( * ) Notice: Subject to any disclaimer, the term of this patent is extended or adjusted under 35 U.S.C. 154(b) by 0 days.

(21) Appl. No.: 17/458,898

(22) Filed: Aug. 27, 2021

Related U.S. Application Data

(60) Provisional application No. 63/071,520, filed on Aug. 28, 2020.

(51) Int. Cl.
*G08B 13/196* (2006.01)
*G08B 15/02* (2006.01)
*G08B 7/06* (2006.01)

(52) U.S. Cl.
CPC ..... *G08B 15/02* (2013.01); *G08B 7/06* (2013.01)

(58) Field of Classification Search
CPC ..... G08B 15/00; G08B 15/02; G08B 7/06; G08B 13/19691; G08B 13/19697
See application file for complete search history.

(56) References Cited

U.S. PATENT DOCUMENTS 4,841,752 A * 6/1989 Fletcher ..... E05G 1/12 109/20
5,819,124 A * 10/1998 Somner ..... G08B 13/19658 396/263
11,050,904 B2 * 6/2021 Ujiie ..... G08B 13/19619
2006/0086348 A1 * 4/2006 Song ..... G08B 15/007 124/56
2008/0231705 A1 * 9/2008 Keller ..... G08B 13/196 348/154
2010/0128123 A1 * 5/2010 DiPoala ..... G08B 15/02 348/143
2011/0279270 A1 * 11/2011 Marckwald ..... G08B 15/00 340/545.1
2013/0106605 A1 * 5/2013 Mullins ..... G08B 15/00 340/541

* cited by examiner

*Primary Examiner* — An T Nguyen
(74) *Attorney, Agent, or Firm* — Plager Schack LLP; Mark H. Plager; Stephen Hallberg

(57) ABSTRACT

A non-lethal intruder deterrent and suppression device capable of temporary incapacitation is disclosed. The non-lethal intruder deterrent and suppression device capable of temporary incapacitation includes a video camera with audio recording capabilities, a light ring, and a spray nozzle to spray a formula as means for deterring and/or temporarily incapacitating an intruder, an active shooter, a terrorist, a thief, and/or an assailant.

9 Claims, 6 Drawing Sheets

NON-LETHAL INTRUDER DETERRENT AND SUPPRESSION DEVICE CAPABLE OF TEMPORARILY INCAPACITATING UNWANTED INTRUDERS

CLAIM OF BENEFIT TO PRIOR APPLICATION

This application claims benefit to U.S. Provisional Patent Application 63/071,520, entitled "A NON-LETHAL INTRUDER DETERRENT DEVICE CAPABLE OF TEMPORARY INCAPACITATION," filed Aug. 28, 2020. The U.S. Provisional Patent Application 63/071,520 is incorporated herein by reference.

BACKGROUND

Embodiments of the invention described in this specification relate generally to security and safety systems, and more particularly, to a non-lethal intruder deterrent and suppression device capable of temporary incapacitation of intruders, terrorists, active shooters, looters, robbers, hijackers, and other violent perpetrators that is capable of temporarily incapacitating a suspected intruder or any other perpetrator in a non-lethal, non-impact manner.

Many people are fearful of unwanted intruders, violent perpetrators, or terrorists at schools, government offices, place of residence, or place of business. While some people may own lethal weapons, the laws in different states vary as to the permitted usage of such weapons. Furthermore, many people are reluctant to own or possess lethal weapons due to the personal risk and/or for reasons they may never wish to use lethal force against another person. Additionally, in the event of an unwanted intruder or violent perpetrator, it is the nature of some people to avoid lethal force, preferring instead to employ nonlethal means of stopping the perpetrator.

Contacting law enforcement is always an option. However, the average response time by law enforcement to an active-shooter or other violent event is eighteen minutes (FBI statistics). The average active shooter (or other assailant event) lasts for less than eight minutes (FBI statistics). This means the intended victims are without law enforcement protection when it is needed most. FBI and law enforcement currently recommend only three methods of response until police arrive: (1) flee the building and the area, if possible, in a direction away from the shooter; (2) hide and hope the shooter does not locate his intended target(s); or as a last resort and where doing nothing would mean certain death, (3) rush at the shooter with an improvised weapon (a pencil, pen, or hammer). To date, there is no known successful "attack" by victims on an active shooter. The average time available to make a life-saving decision from among the three options is less than one minute.

Other existing security systems may provide warning of intruders (such as by an alarm), but they do nothing to stop or halt such intruders, and therefore, leave people vulnerable to the nefarious purposes of the suspect.

In the case of schools or government offices, law enforcement officers may be present and deploy lethal force to stop the intruder. The use of lethal force often results in the death of the suspect and innocent bystanders. Lethal force against a child, or lethal force against a teenager wielding a toy or replica of a firearm is a nightmare scenario for any law enforcement officer and risks injury or death to bystanders. Law enforcement and schools need and want another option that does not endanger the life of any child, nor risk the life of any bystander when stopping an intruder.

The same problem is analogous to homeowners when experiencing someone attempting to enter the home. Likewise, senior citizens are fearful of intruders in the home but cannot flee in time to avoid a suspect.

Therefore, what is needed is a non-lethal security system that protects against unwanted intruders into schools, government offices, residences, or places of business to quickly (say, in less than two seconds) and safely (to the defender and to the suspect) incapacitate or immobilize the armed or dangerous person before or during the entry, until the police or other law enforcement arrives, where the security system is a "stand-off" type system in nature so as not to risk a face-to-face confrontation by an intruder, a terrorist, an active-shooter, violent perpetrator, or any other unwanted person event without the risk of being shot by the active-shooter, or any other unwanted intruder who poses a danger or security risk, where incapacitation of intruders who pose a danger or security risk must last for a sufficient duration of time (say, thirty minutes to two hours), thereby allowing for law enforcement to respond and safely take a suspect into custody without the use of firearms or other lethal weapons.

BRIEF DESCRIPTION

A novel non-lethal intruder deterrent and suppression device is disclosed that is capable of temporarily incapacitating an intruder, an active shooter, a terrorist, a thief, an assailant, or any other perpetrator (hereinafter referred collectively and/or individually as "unwanted intruders"). In some embodiments, the non-lethal intruder deterrent and suppression device capable of temporarily incapacitating unwanted intruders provides protection for people against unwanted intruders in many places, such as schools, government offices, airports, residences, places of business, and other such gathering places of people.

In some embodiments, the non-lethal intruder deterrent and suppression device comprises a pre-filled tank filled with a non-lethal formula, which, when sprayed at a pre-set target area when any unwanted intruder(s) is within the pre-set target area, renders the unwanted intruder(s) temporarily incapacitated. In some embodiments, the non-lethal intruder deterrent and suppression device comprises pivoting and tilting nozzle that is configured to spray the non-lethal formula toward the unwanted intruder(s). In some embodiments, the pivoting and tilting nozzle is connected to the pre-filled tank and is capable of being aimed at the unwanted intruder(s) to spray the non-lethal formula from the tank toward the unwanted intruder(s). In some embodiments, the pre-filled tank comprises a plurality of pivoting and tilting nozzles capable of being aimed at the unwanted intruder(s) to spray the non-lethal formula from the tank toward the unwanted intruder(s). In some embodiments, the non-lethal intruder deterrent and suppression device comprises a high intensity light that acts as a secondary deterrent to the unwanted intruder(s) by inhibiting the unwanted intruder's ability to face or see in the direction of the light. In some embodiments, the high intensity light shines with at least a brightness of 2,500 lumens. In some embodiments, the high intensity light comprises a strobe light that flashes. In some embodiments, the high intensity light comprises a direct light. In some embodiments, the non-lethal intruder deterrent and suppression device comprises a video camera the captures video in relation to unwanted intruder(s). In some embodiments, the video camera also records audio as part of the video capture. In some embodiments, the video camera comprises a high-definition video camera. In some embodiments, the high-definition video camera comprises a night vision camera that permits visibility in darkness in a target video capture area. In some embodiments, the high-definition video camera comprises an infrared camera that provides thermal imaging with thermal temperature readout when capturing video in the target video capture area. In some embodiments, the video camera comprises a closed circuit high-definition camera that records the interactions and event surrounding the unwanted intruder(s). In some embodiments, the non-lethal intruder deterrent and suppression device comprises infrared sensors and cameras, night vision technology, motion sensor activation, thermal imaging cameras, and thermal temperature reading sensors. In some embodiments, the non-lethal intruder deterrent and suppression device further comprises a sound wave generating audio device which, upon generating and outputting the sound wave, induces nausea and incapacitates the unwanted intruder(s).

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Figure 1:
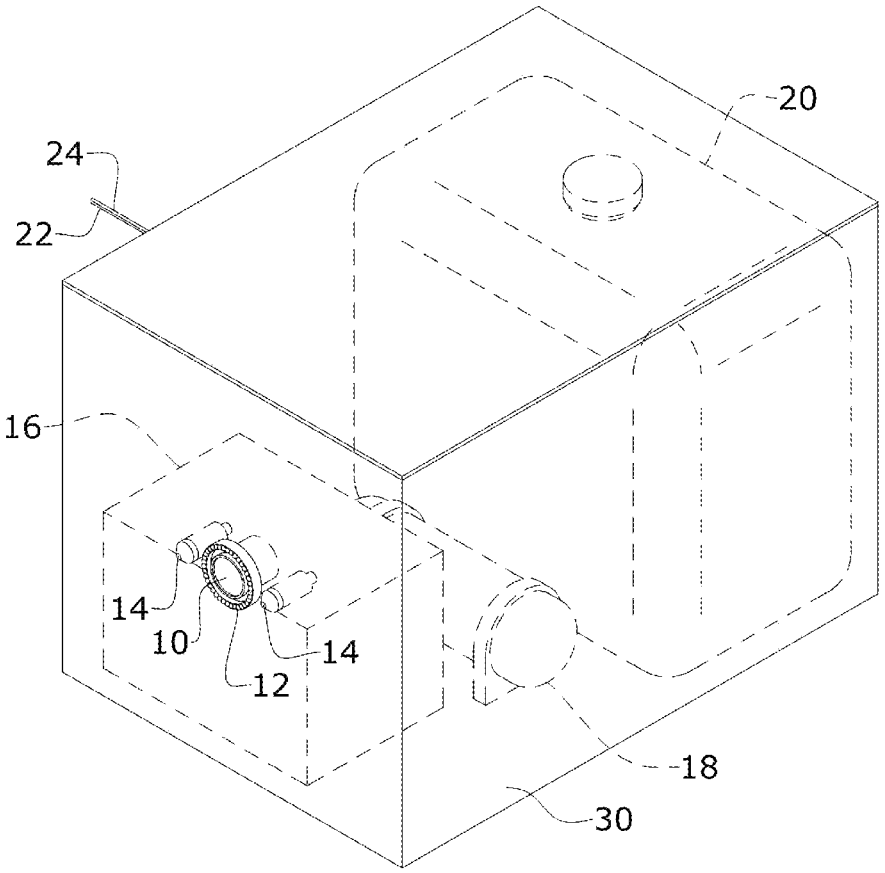

Having thus described the invention in general terms, reference is now made to the accompanying drawings, which are not necessarily drawn to scale, and which show different views of different example embodiments, and wherein:

FIG. 1 conceptually illustrates a perspective view of a first non-lethal intruder deterrent and suppression device capable of temporarily incapacitating unwanted intruders in some embodiments.

Figure 2:
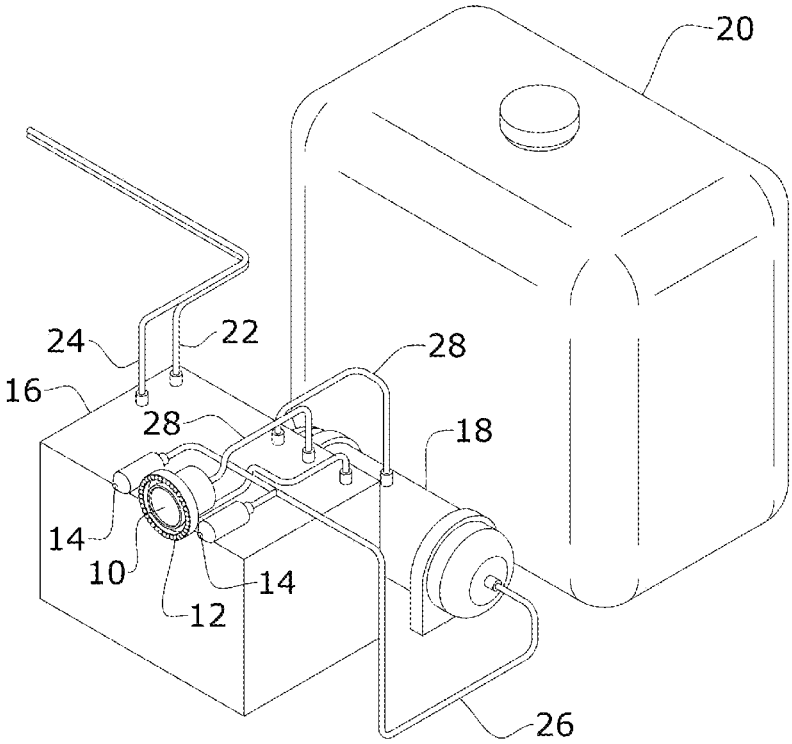

FIG. 2 conceptually illustrates a perspective view of internal components of the first non-lethal intruder deterrent and suppression device in some embodiments with the secure compartment housing removed.

Figure 3:
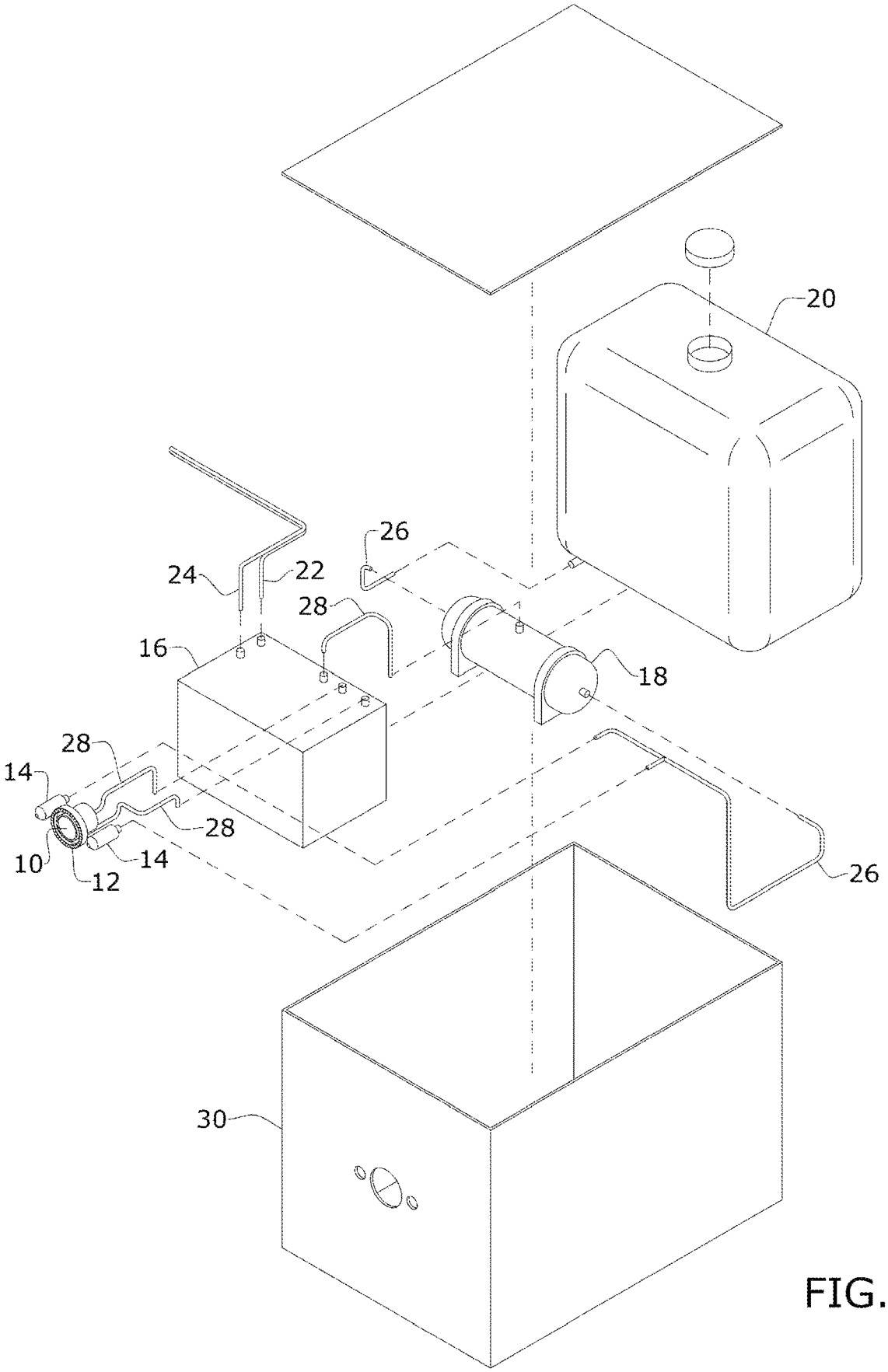

FIG. 3 conceptually illustrates an exploded view of the first non-lethal intruder deterrent and suppression device capable of temporarily incapacitating unwanted intruders in some embodiments.

Figure 4:
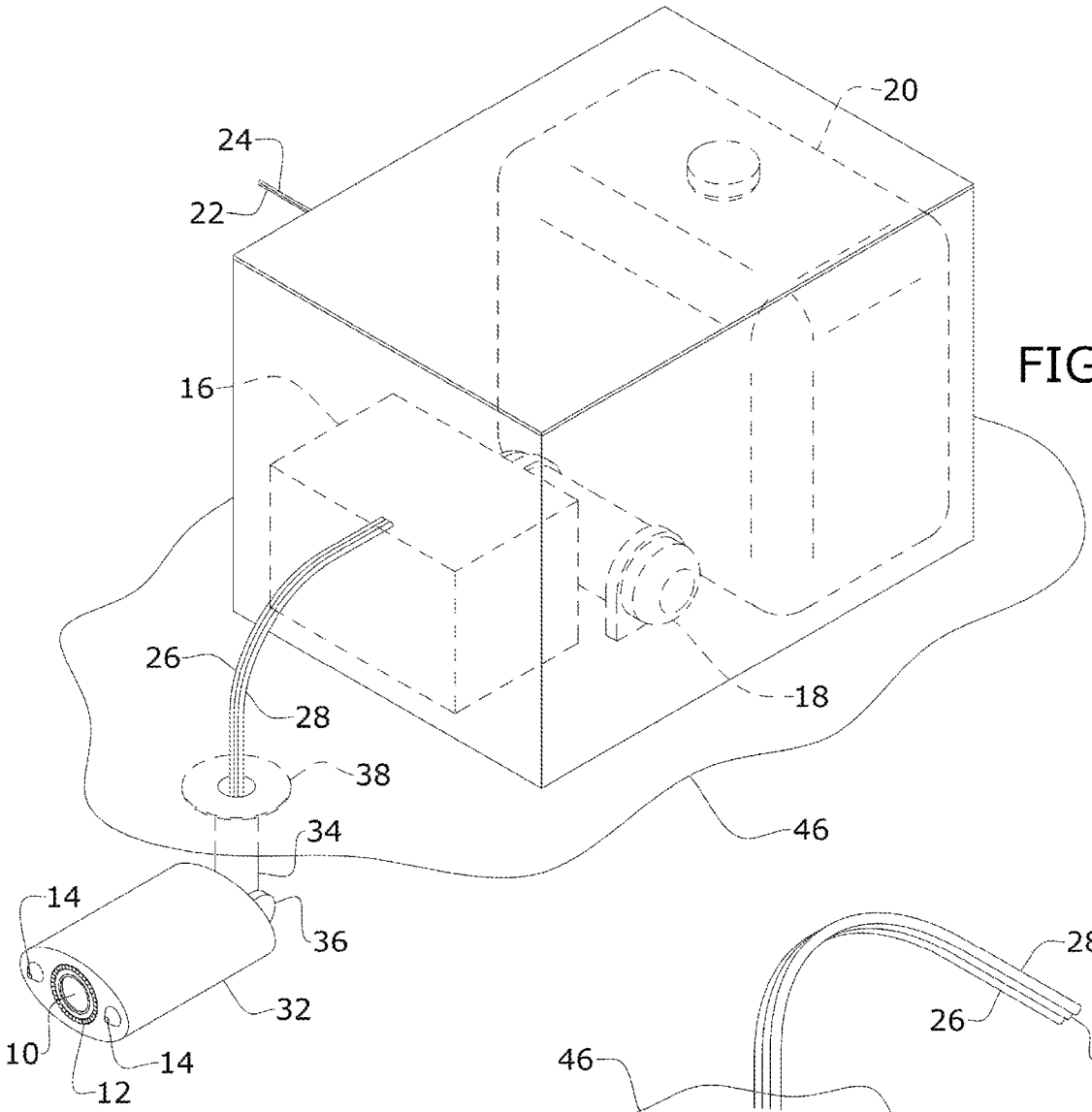

FIG. 4 conceptually illustrates a perspective view of a second non-lethal intruder deterrent and suppression device capable of temporarily incapacitating unwanted intruders in some embodiments.

Figure 5:
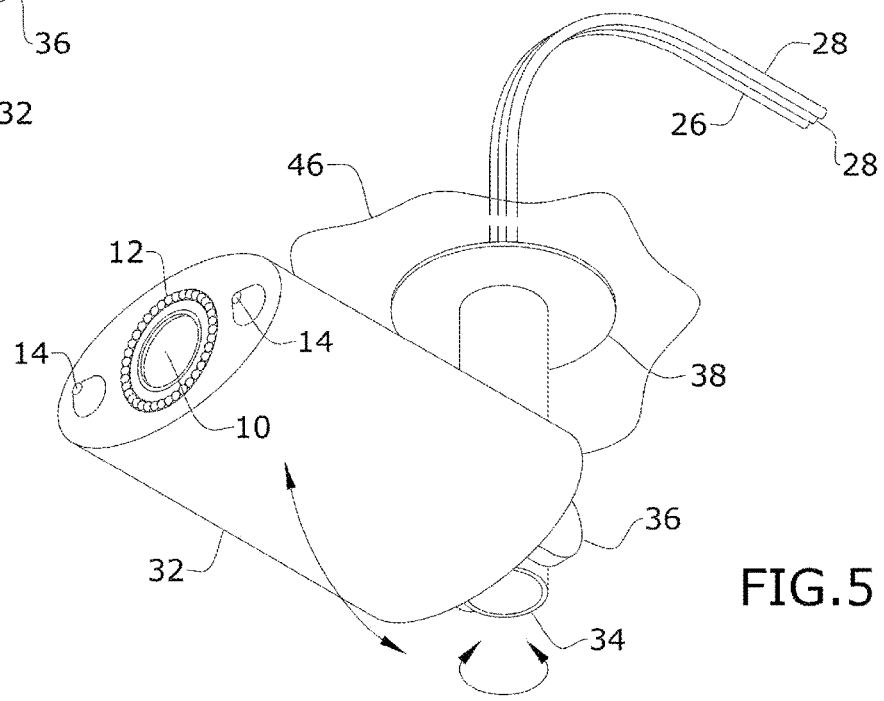

FIG. 5 conceptually illustrates a bottom perspective view of the second non-lethal intruder deterrent and suppression device capable of temporarily incapacitating unwanted intruders in some embodiments.

Figure 6:
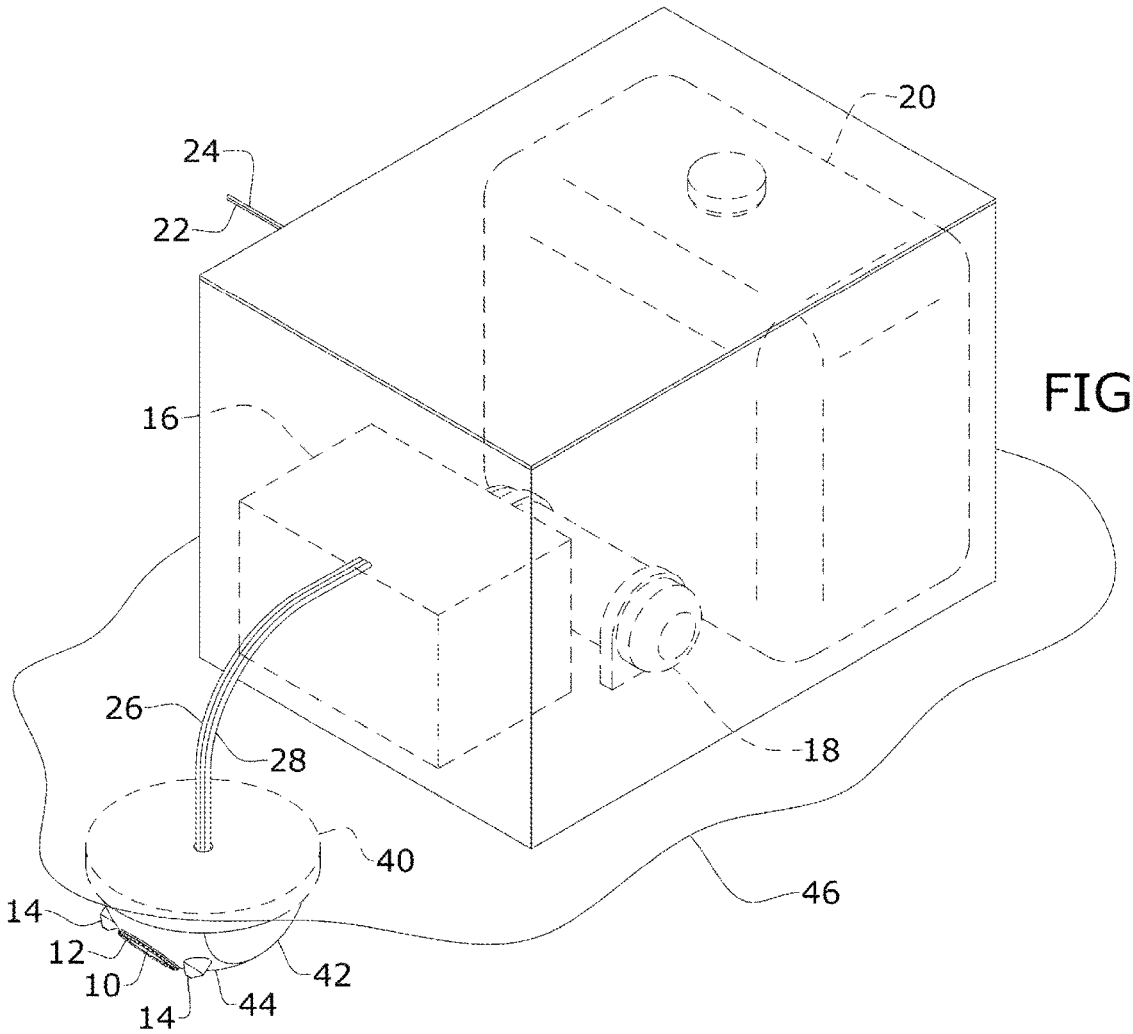

FIG. 6 conceptually illustrates a perspective view of a third non-lethal intruder deterrent and suppression device capable of temporarily incapacitating unwanted intruders in some embodiments.

Figure 7:
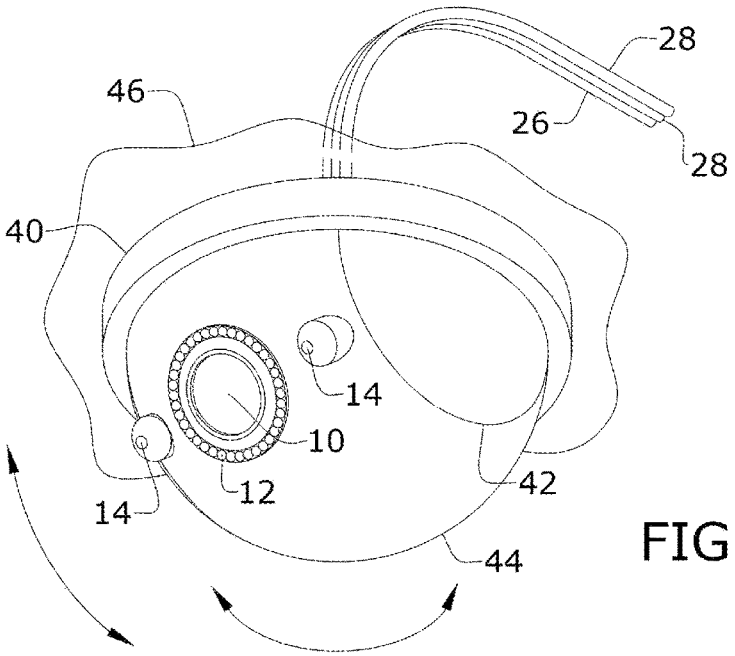

FIG. 7 conceptually illustrates a bottom perspective view of the third non-lethal intruder deterrent and suppression device capable of temporarily incapacitating unwanted intruders in some embodiments.

Figure 8:
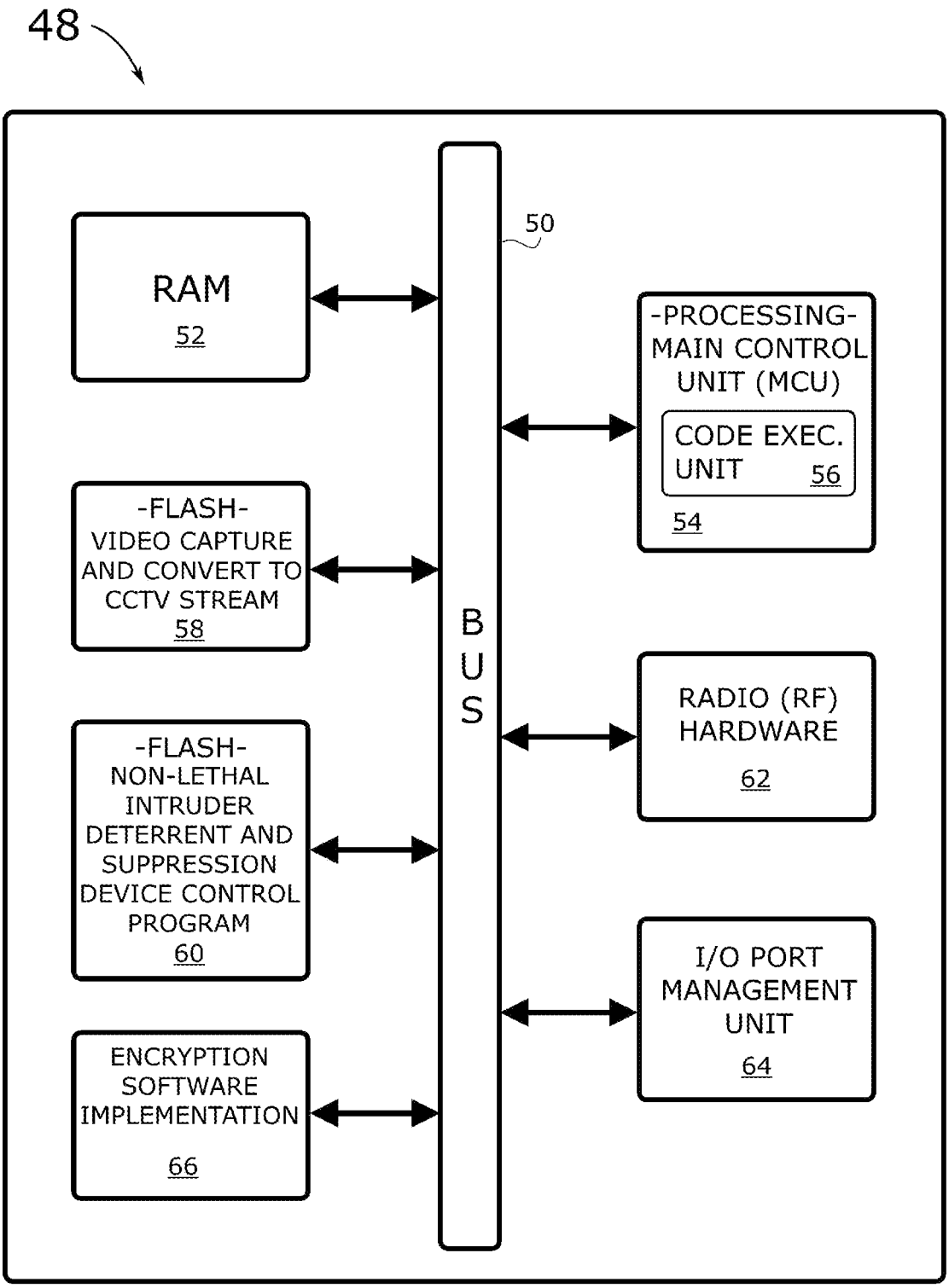

FIG. 8 conceptually illustrates a block diagram of a computing device that manages data commands and device operation for the computer controlled internal pump and delivery system encapsulated within the control box of a non-lethal intruder deterrent and suppression device in some embodiments.

Figure 9:
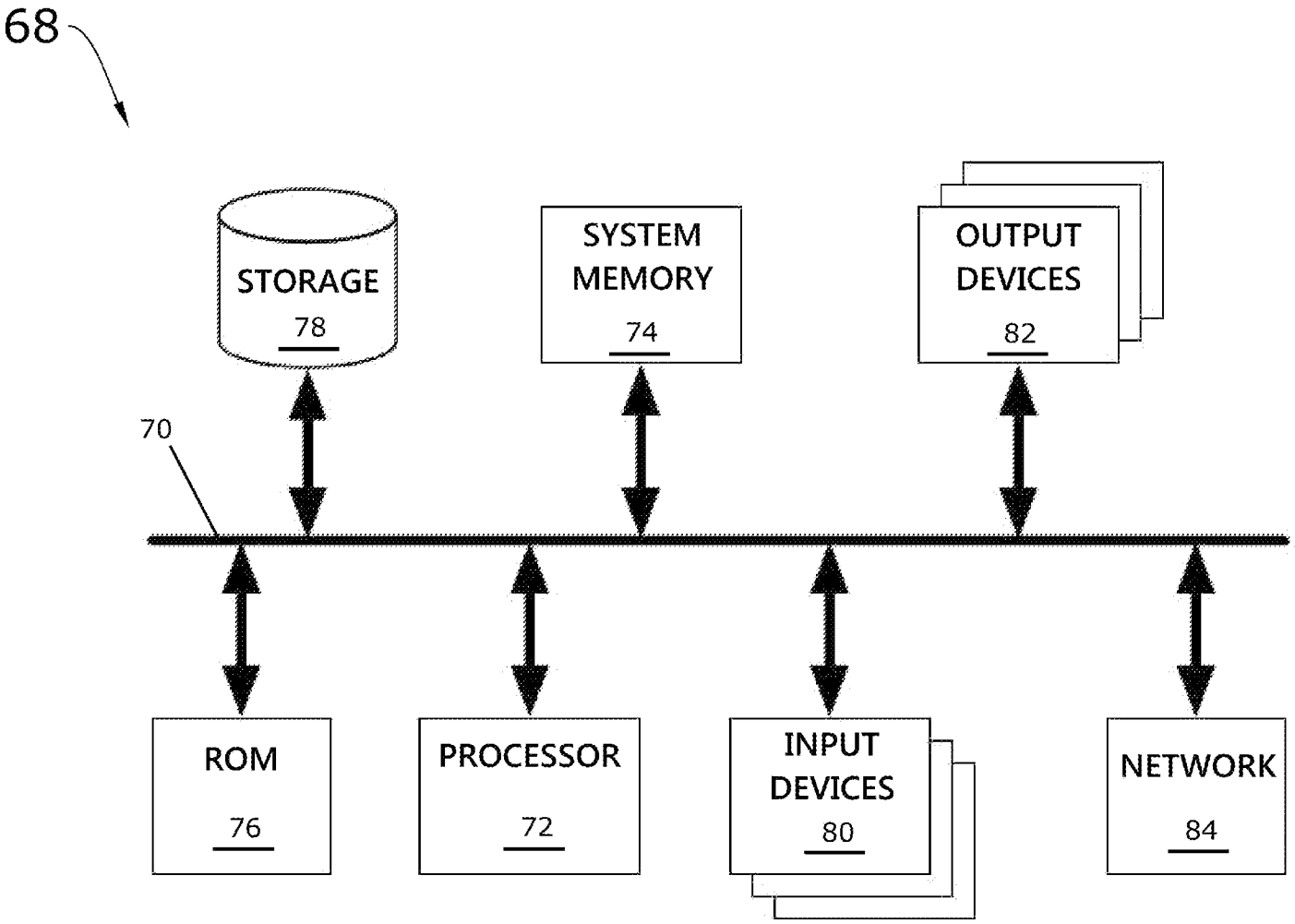

FIG. 9 conceptually illustrates an electronic system with which some embodiments of the invention are implemented.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments provide a non-lethal intruder deterrent and suppression device capable of temporarily incapacitating unwanted intruders. In some embodiments, the non-lethal intruder deterrent and suppression device is deployed in a residence, a place of business, a school, a government office, an airport, or other locations in which people are frequently present, and provides protection for people against the unwanted intruders.

In some embodiments, the non-lethal intruder deterrent and suppression device comprises a pre-filled tank filled with a non-lethal formula, which, when sprayed at a pre-set target area when any unwanted intruder(s) is within the pre-set target area, renders the unwanted intruder(s) temporarily incapacitated. In some embodiments, the non-lethal intruder deterrent and suppression device comprises pivoting and tilting nozzle that is configured to spray the non-lethal formula toward the unwanted intruder(s). In some embodiments, the pivoting and tilting nozzle is connected to the pre-filled tank and is capable of being aimed at the unwanted intruder(s) to spray the non-lethal formula from the tank toward the unwanted intruder(s). In some embodiments, the pre-filled tank comprises a plurality of pivoting and tilting nozzles capable of being aimed at the unwanted intruder(s) to spray the non-lethal formula from the tank toward the unwanted intruder(s). In some embodiments, the non-lethal intruder deterrent and suppression device comprises a high intensity light that acts as a secondary deterrent to the unwanted intruder(s) by inhibiting the unwanted intruder's ability to face or see in the direction of the light. In some embodiments, the high intensity light shines with at least a brightness of 2,500 lumens. In some embodiments, the high intensity light comprises a strobe light that flashes. In some embodiments, the high intensity light comprises a direct light. In some embodiments, the non-lethal intruder deterrent and suppression device comprises a video camera the captures video in relation to unwanted intruder(s). In some embodiments, the video camera records audio in connection with the video capture. In some embodiments, the video camera comprises a high-definition video camera. In some embodiments, the high-definition video camera comprises a night vision camera that permits visibility in darkness in a target video capture area. In some embodiments, the high-definition video camera comprises an infrared camera that provides thermal imaging with thermal temperature readout when capturing video in the target video capture area. In some embodiments, the video camera comprises a closed circuit high-definition camera that records the interactions and event surrounding the unwanted intruder(s). In some embodiments, the non-lethal intruder deterrent and suppression device comprises infrared sensors and cameras, night vision technology, motion sensor activation, thermal imaging cameras, and thermal temperature reading sensors. In some embodiments, the non-lethal intruder deterrent and suppression device further comprises a sound wave generating audio device which, upon generating and outputting the sound wave, induces nausea and incapacitates the unwanted intruder(s).

Embodiments of the non-lethal intruder deterrent and suppression device capable of temporarily incapacitating any such unwanted intruders described in this specification solve the problems described above by remote activation of the non-lethal intruder deterrent and suppression device, whereby a person may discharge a pre-filled tank of a non-lethal proprietary formula that will render any unwanted intruder(s) temporarily incapacitated. The pre-filled tank is encased in a permanently installed location with a pre-set target area, with an option to have a pivoting and tilting nozzle or a plurality of pivoting and tilting nozzles included which are capable of being aimed by the user (either physically or remotely) to discharge a non-lethal incapacitating spray formula in the direction of the pre-set target area or in another direction toward the unwanted intruder(s).

The purpose of the non-lethal intruder deterrent and suppression device is to provide a "stand-off", non-lethal means of deterring and/or temporarily incapacitating an intruder, a terrorist, an active shooter, a thief, and/or an assailant at a distance from the intended target (the "stand-off" distance). In some embodiments, the non-lethal intruder deterrent and suppression device discharges the formula in a spray, a light (also referred to as a "dazzler" with ability to shine strobe or direct light) with a brightness intensity measuring at least 2,500 lumens and which acts as a secondary deterrent to the assailant by inhibiting the assailant's vision by making it difficult to face or see in the direction of the light/device. In some embodiments, the non-lethal intruder deterrent and suppression device may be operated indoors or outdoors, by direct "on/off" toggling of a power switch, a computer, or through a smart phone or tablet computing device.

In some embodiments, the non-lethal intruder deterrent and suppression device is intended to be fixed/mounted in a location to provide for defense against violent and other criminal activity within a specified area (the pre-set target area) and range from 100 square feet to as much as 1,000 square feet, depending on options selected. For all models of the non-lethal intruder deterrent and suppression device the nozzle, dazzler, and camera are aligned to the same target area.

The non-lethal intruder deterrent and suppression device of the present disclosure may be comprised of the following elements. This list of possible constituent elements is intended to be exemplary only and it is not intended that this list be used to limit the non-lethal intruder deterrent and suppression device of the present application to just these elements. Persons having ordinary skill in the art relevant to the present disclosure may understand there to be equivalent elements that may be substituted within the present disclosure without changing the essential function or operation of the non-lethal intruder deterrent and suppression device.

1. In a first configuration (referred to as "MODEL A"), the non-lethal intruder deterrent and suppression device includes a computer controlled internal pump and delivery system that is encased in a rectangular control box. The non-lethal intruder deterrent and suppression device in the first configuration "MODEL A" is fixed/mounted to a ceiling or wall. The non-lethal intruder deterrent and suppression device for "MODEL A" may be operated by physical toggling of a power switch ("on/off" switch) or remotely via a computing device of an operator (e.g., a smartphone, a tablet computing device, a laptop or desktop computer, etc.). The non-lethal intruder deterrent and suppression device for "MODEL A" is permanently mounted to target a pre-designated area (the "pre-set target area") where an unwanted intruder is likely to enter or egress. When deployed in the first configuration, the non-lethal intruder deterrent and suppression device for MODEL A is not concealed and, therefore, is visible.

By way of example, FIG. 1 conceptually illustrates a perspective view of a first non-lethal intruder deterrent and suppression device capable of temporarily incapacitating unwanted intruders. The first non-lethal intruder deterrent and suppression device shown in this figure demonstrates an example of a "MODEL A" version of a non-lethal intruder deterrent and suppression device that is mounted to a visible surface, such as a ceiling or wall. As shown in this figure, the first non-lethal intruder deterrent and suppression device comprises a camera 10, a light ring 12, a pair of spray nozzles 14, a control box 16, a pump 18, a tank 20, a power cord 22, and a CCTV cord 24, and a secure compartment housing 30. While not shown in this figure, the first non-lethal intruder deterrent and suppression device may also include a power switch for physically toggling power on/off by a person (operator). The secure compartment housing 30 encapsulates all of the other components of the first non-lethal intruder deterrent and suppression device with exception of the camera 10, the light ring 12, and the spray nozzles 14, each of which either protrude through or are aligned flush to an outer surface of the secure compartment housing 30. In addition, the power cord 22 and the CCTV cord 24 both extend through the secure compartment housing 30 and out of the first non-lethal intruder deterrent and suppression device to a power source and video receiving and/or displaying devices, respectively.

Turning to another view, FIG. 2 conceptually illustrates a perspective view of internal components of the first non-lethal intruder deterrent and suppression device in some embodiments with the secure compartment housing 30 removed. Along with the camera 10, the light ring 12, the pair of spray nozzles 14, the control box 16, the pump 18, the tank 20, the power cord 22, and the CCTV cord 24, the first non-lethal intruder deterrent and suppression device shown in this figure also demonstrates plumbing lines 26 that provide a fluid channel between the pump 18 and the pair of spray nozzles 14 and electrical lines 28 that provide power and operational commands from the control box 16 to the camera 10, the light ring 12, and the pump 18. Additionally, the control box 16 includes an electronic system (not shown) that manages data flow and controls real-time operation of the camera 10, the light ring 12, the pair of spray nozzles 14, and the pump 18. The pump 18, when activated via powered command over one of the electrical lines 28 by the electronic system embedded within the control box 16, pumps liquid from the tank 20 and channels the liquid through the plumbing lines 26 to the pair of spray nozzles 14 for outward spraying of the liquid in the direction of a detected unwanted intruder in the pre-set target area. Likewise, the camera 10, when activated via powered command over the other electrical lines 28 by the electronic system embedded within the control box 16, captures video in the direction of the detected unwanted intruder in the pre-set target area and streams the captured video out the CCTV code 24 to a display device or other destination. Similarly, the light ring 12, when activated via powered command over the other electrical lines 28 by the electronic system embedded within the control box 16, shines a high intensity light (as a direct or strobe light with the 2,500 lumens minimum brightness) in the direction of the detected unwanted intruder in the pre-set target area to temporarily limit vision of the unwanted intruder detected in the pre-set target area.

By way of another perspective, FIG. 3 conceptually illustrates an exploded view of the first non-lethal intruder deterrent and suppression device capable of temporarily incapacitating unwanted intruders in some embodiments. In this figure, apertures are shown on the outer surface of the secure compartment housing 30 through which the camera 10, the light ring 12, and the spray nozzles 14 protrude or align flush to the outer surface. Additionally, separate electrical lines 28 are clear visible in connection with each of the camera 10 and the light ring 12. Also, a second plumbing line 26 is shown in this figure as connecting between the pump 18 and the fluid tank 20, specifically connecting to a fluid outlet at the bottom of the tank 20. Additionally, access to the inner components within the secure compartment housing 30 is possible by removal of a top surface. In this way, a person can refill fluid in the tank 20, which includes a cap that can be removed.

2. In a second configuration (referred to as "MODEL B"), the non-lethal intruder deterrent and suppression device is assembled as noted above in reference to "MODEL A", with one difference being that the main housing is concealed in the ceiling, with exception for an additional arm, sphere, or box in connection with a camera, a light (the "dazzler"), and one or more spray nozzle(s) (hereinafter also referred to as the "pod" or the "pod components") exposed below the ceiling in a fixed position. In this configuration for "MODEL B", the delivery point is where the arm, sphere, or box are exposed. At least in part, therefore, the non-lethal intruder deterrent and suppression device for MODEL B is fixed/mounted to a ceiling or a wall with another part concealed behind the ceiling or wall. However, the pod components can be pivoted and tilted to allow an operator to aim toward an unwanted intruder. Also, the non-lethal intruder deterrent and suppression device for "MODEL B" may be operated by physical toggling of a power switch (the operator switches power "on/off" via switch) or remotely via a computing device of an operator (e.g., a smartphone, a tablet computing device, a laptop or desktop computer, etc.). Similarly, the non-lethal intruder deterrent and suppression device for "MODEL B" is permanently mounted with respect to the ceiling or wall position but can target a range beyond the pre-set target area by pivoting and/or tilting the pod in a direction of an unwanted intruder. In addition to having a fixed position, another difference with the non-lethal intruder deterrent and suppression device for "MODEL A" is that the non-lethal intruder deterrent and suppression device for "MODEL B" is partially concealed from view from the unwanted intruder(s), except for the pod with the spray nozzle(s), the dazzler, and the camera.

By way of example, FIG. 4 conceptually illustrates a perspective view of a second non-lethal intruder deterrent and suppression device capable of temporarily incapacitating unwanted intruders in some embodiments. The second non-lethal intruder deterrent and suppression device shown in this figure demonstrates an example of a "MODEL B" version of a non-lethal intruder deterrent and suppression device. The second non-lethal intruder deterrent and suppression device shown in this figure comprises a first plurality of concealed components that are mounted above a ceiling 46 and a second plurality of components exposed beneath the ceiling 46. In particular, the first plurality of concealed components that are mounted above a ceiling 46 comprises the control box 16, the pump 18, the tank 20, the power cord 22, the CCTV cord 24, the plumbing lines 26, and electrical lines 28. The second plurality of components exposed beneath the ceiling 46 comprises the camera 10, the light ring 12, the pair of spray nozzles 14, a pod case 32, a pivot shaft 34, a tilt hinge 36, and a mount plate 38. Unlike the secure compartment housing 30 that encapsulated the components of the first non-lethal intruder deterrent and suppression device described above, by reference to FIGS. 1-3, the main housing of the second non-lethal intruder deterrent and suppression device only encapsulates the control box 16, the pump 18, and the tank 20, with the power cord 22, the CCTV cord 24, the plumbing lines 26, and electrical lines 28 all extending out of the main housing. In particular, the plumbing lines 26 and electrical lines 28 both extend out and down through the mount plate 38 and the pivot shaft 34 to the pod components. Specifically, the plumbing lines 26 extend to the pair of spray nozzles 14 while the electrical lines 28 extend to the camera 10, the light ring 12, and the pair of spray nozzles 14 to provide power.

Turning to another "MODEL B" example, FIG. 5 conceptually illustrates a bottom perspective view of the second non-lethal intruder deterrent and suppression device. In this view, pivoting is shown by a semi-circular arrow adjacent to the pivot shaft 34. Similarly, tilting is shown by a curvilinear arrow adjacent to the pod case 32, and demonstrating tilting motion as actuated by the tilt hinge 36. In some embodiments, the tilt hinge 36 supports a limited range of motion for tilting the pod case 32. In some embodiments, the range of motion over which the pod case 32 can be tilted, by actuation of the tilt hinge 36, is less than 360° due (at least in part) to the presence of the pivot shaft 34. In some embodiments, the pivot shaft 34 supports a 360° range of motion over which the pod case 32 can be pivoted.

3. In a third configuration (referred to as "MODEL C"), the non-lethal intruder deterrent and suppression device is similar to the non-lethal intruder deterrent and suppression device for "MODEL B", with a minimal set of components exposed beneath a ceiling or wall, and the remaining components concealed above the ceiling or behind the wall. The minimal set of components (or "pod components") may be housed in a sphere or by an arm extension. A spherical housing or arm extension for the pod components is configured to pivot along two axes (or rather, "pivoting" along one axis and "tilting" along the other axis). Unlike the non-lethal intruder deterrent and suppression device for "MODEL A" and "MODEL B" which limit the focus to the pre-set target area, the non-lethal intruder deterrent and suppression device for "MODEL C" allows the operating user to focus on different target areas. In some embodiments, the non-lethal intruder deterrent and suppression device for "MODEL C" is fixed/mounted to the ceiling or the wall, is capable of remote operation, and is partially concealed from view of the unwanted intruder, except for the pod with the camera, the dazzler, and the spray nozzle components. The pod for the non-lethal intruder deterrent and suppression device in "MODEL C" pivots on two axes with a limited range of motion along each axis. In some embodiments, the range of motion along a horizontal oriented axis is up to 180° of pivoting motion. In some embodiments with the spherical pod housing, the range of motion along the horizontal oriented axis is up to 360° of pivoting motion. In some embodiments, the range of motion along a vertical oriented axis is up to 120° of tilting motion. In this way, the non-lethal intruder deterrent and suppression device for "MODEL C" allows the operator to independently direct the discharge (of formula spray, lights, and/or camera) at a specific or moving target. Also, the aiming of the non-lethal intruder deterrent and suppression device for "MODEL C" is synchronized to match the direction of the camera, allowing the operator to "point" the non-lethal intruder deterrent and suppression device from a computer, smart phone, tablet computing, or other computing device before discharging.

By way of a "MODEL C" example, FIG. 6 conceptually illustrates a perspective view of a third non-lethal intruder deterrent and suppression device capable of temporarily incapacitating unwanted intruders in some embodiments. As shown in this figure, the third non-lethal intruder deterrent and suppression device comprises a first plurality of concealed components that are mounted above the ceiling 46 and a second plurality of components exposed beneath the ceiling 46. In particular, the first plurality of concealed components that are mounted above the ceiling 46 comprises the control box 16, the pump 18, the tank 20, the power cord 22, the CCTV cord 24, the plumbing lines 26, and electrical lines 28. The second plurality of components exposed beneath the ceiling 46 comprises the camera 10, the light ring 12, the pair of spray nozzles 14, a pod base 40, a 360° dome 42, and a center tilt 44. Unlike the secure compartment housing 30 that encapsulated the components of the first non-lethal intruder deterrent and suppression device described above, by reference to FIGS. 1-3, the main housing of the third non-lethal intruder deterrent and suppression device only encapsulates the control box 16, the pump 18, and the tank 20, with the power cord 22, the CCTV cord 24, the plumbing lines 26, and electrical lines 28 all extending out of the main housing. In particular, the plumbing lines 26 and electrical lines 28 both extend out of the main housing and down through the ceiling 46 to the spherical pod components. Note that pivoting and tilting motions are demonstrated by curvilinear arrows shown in FIG. 7, which conceptually illustrates a bottom perspective view of the third non-lethal intruder deterrent and suppression device.

Note that each of the different models of the non-lethal intruder deterrent and suppression device capable of temporarily incapacitating unwanted intruders ("MODEL A", "MODEL B", and "MODEL C") may also include motion sensors. While now shown in FIGS. 1-7, the motion sensors may be disposed along surfaces of the pod or housing to enable automatic detection of motion. Also, the various components and elements of the non-lethal intruder deterrent and suppression device of the present disclosure may be related in the following exemplary fashion. It is not intended to limit the scope or nature of the relationships between the various elements and the following examples are presented as illustrative examples only. An operator (or "user") of the non-lethal intruder deterrent and suppression device (for any of "MODEL A", "MODEL B", and "MODEL C") may discharge a pre-filled tank of a proprietary agent (or spray formula) that will render an unwanted intruder temporarily incapacitated. The non-lethal intruder deterrent and suppression device (for all models) also have a high definition (HD) camera to identify an individual or group and record the event. The HD camera of the non-lethal intruder deterrent and suppression device (for all models) have options available for infrared viewing, motion sensor activation, night vision viewing, and thermal imaging and temperature readout (thereby being capable of identifying, for example, persons with potential fever). The non-lethal intruder deterrent and suppression device (for all models) also include a 2,500 lumens (minimum) white strobe dazzler. The dazzler is intended to momentarily deprive any unwanted intruder(s) of their vision. The rectangular box of the non-lethal intruder deterrent and suppression device for "MODEL A" includes the computer-controlled pump, the tank with the liquid agent and data and power lines. Similarly, the non-lethal intruder deterrent and suppression device for "MODEL B" has a small separate box or pod case mounted to an extension arm that itself is mounted to the ceiling or wall. The pod case (or box) is minimally exposed and contains HD camera, spray nozzle, and light dazzler with power, data and hose lines (or rather, plumbing lines) connected to the pod case (or box), while the non-lethal intruder deterrent and suppression device for "MODEL C" has a minimally exposed pivoting spherical component (the 360° dome) which enables the user to aim the camera, light dazzler, and nozzles to spray at a desired point or target.

The non-lethal intruder deterrent and suppression device of the present disclosure generally works by aligning the nozzle, dazzler, and camera for the non-lethal intruder deterrent and suppression device to the same target area (pre-set target area), with the ability (in the non-lethal intruder deterrent and suppression device for "MODEL C") to adjust the target area at the user's option. The non-lethal intruder deterrent and suppression device may be activated through the on/off switch located within the same premises which is directly connected to the device or may be remotely activated WiFi through a smart phone, tablet, or computer. The camera is a continually operating and recording device and provides viewing and recording independent of the spray pump, nozzle, and dazzler, thereby allowing the user the discretion of whether or not to activate the defensive measures of the spray agent and white light dazzler. Furthermore, the camera's video recording capability (with or without audio recording) provides the user with physical evidence demonstrating the circumstances which lead to the deployment of the proprietary spray agent and dazzler. In some embodiments, the spray agent is a proprietary spray agent that is formulated as a non-hazardous, non-flammable, and non-toxic spray agent. Nevertheless, the spray agent is able to cause temporary disorientation to the targeted unwanted intruder who precipitated the need for defense by user.

To make the non-lethal intruder deterrent and suppression device of the present disclosure, a person (or user) would add the proprietary mix of non-hazardous, non-flammable, non-toxic spray agent materials to the non-lethal intruder deterrent and suppression device, which, when sprayed, would disorient and incapacitate the unwanted intruder(s). The tank, electric or pneumatic pump, hoses, and nozzle serve together as the delivery system of the proprietary agent. The 2,500 lumens (or more) direct light or strobe dazzler is an off-the shelf component. The camera may be an off-the shelf item. The CPU or on/off switch must be programmed to signal the operation of the device (horizontal pivoting or vertical pivoting while using the camera, while reserving the activation of the defensive features to a separate "on/off" decision operation by the user to ensure safety and avoid activation when the circumstances do not warrant defense. The proprietary spray agent is non-lethal and is not a firearm. Thus, the non-lethal intruder deterrent and suppression device does not fire or discharge any projectiles. On the contrary, the non-lethal intruder deterrent and suppression device is intended to avoid the use of lethal force in any circumstances, so as to preserve life of the user (operator), innocent bystanders, and the unwanted intruder(s) even when the unwanted intruder is an active shooter.

Also, the proprietary spray agent is essential to safely incapacitate a person for a brief time. The agent is contained in a 1-gallon tank inside the case or body of the non-lethal intruder deterrent and suppression device. A hose is connected to the tank, linking it to a small, electric pump. The pump, when activated, draws the spray agent from the tank, through the hose, through the pump, through another hose, and then through a small nozzle. The other deterrent, the 2,500 lumens light dazzler, is too bright for the human eye to see through or past it and serves as a secondary deterrent against the unwanted intruder moving in the direction of the light. The agent and the dazzler operate (either separately or in tandem) to push the unwanted intruder away from the pre-set target area. The camera permits the operator to observe movements and actions of the unwanted intruder and determine whether or not the circumstances warrant the discharge of the proprietary spray agent and the dazzler. The camera also allows the operator to "see" in the dark using infrared and night vision. The on/off activation permits the operator to operate the camera without having to deploy the agent or light. The camera records events prior to, during, and after the discharge of the defensive features (agent and dazzler). The case, or exterior body of the non-lethal intruder deterrent and suppression device, secures all of the components and prevents tampering or damage to the non-lethal intruder deterrent and suppression device. The WiFi is installed within the case to permit the operator to operate the camera and view it on a remote display of a smart phone, a tablet device, a monitor, or a computer. Through WiFi, the non-lethal intruder deterrent and suppression device's defensive measures (spray agent and dazzler) may be deployed without the operator being present at the location of the non-lethal intruder deterrent and suppression device. The thermal temperature imaging and sensor-based read-out permits the operator to determine the likelihood an unwanted intruder (or anyone) is suffering a fever or is potentially infected by an unknown virus (such as, without limitation, COVID-19). Automatic police notification, or notification to a commercial security company whose security system is pre-existing at the premises, is an option that is available to the non-lethal intruder deterrent and suppression device. Additional hoses may be used by the non-lethal intruder deterrent and suppression device to deliver the proprietary spray agent over a wider area. In some embodiments, it is possible to link multiple non-lethal intruder deterrent and suppression devices through a network and a single CPU to create a networked matrix of local or distributed non-lethal intruder deterrent and suppression devices, operated from a single switch, smart hub, smart phone, tablet device, or computer.

In some embodiments, the non-lethal intruder deterrent and suppression device is configured to operate whether or not a dazzler is installed or active. In some embodiments, the non-lethal intruder deterrent and suppression device may configure with or without infrared, night vision, or thermal temperature imaging sensors. As mentioned above, an optional configuration of the non-lethal intruder deterrent and suppression device automatically signals police (dialing "911") of a violent event in progress at the address where the non-lethal intruder deterrent and suppression device is installed. Another option engages an electric actuator that causes the turret to pivot horizontally or vertically, as directed by an operator, such as is described above in the non-lethal intruder deterrent and suppression device for "MODEL C".

By way of example, FIG. 8 conceptually illustrates a block diagram of a computing device 48 that manages data commands and device operation for the computer controlled internal pump and delivery system encapsulated within the control box of a non-lethal intruder deterrent and suppression device in some embodiments. As shown in this figure, the computing device 48 includes a bus 50, a random access memory (RAM) 52, a main control unit (MCU) 54 for runtime processing of a non-lethal intruder deterrent and suppression device control program running on the computing device 48, a code execution unit 56 embedded within the MCU 54, a first persistent flash memory 58 that stores a video capture and convert to CCTV stream program to store HD video captured by the HD camera and convert the captured HD video into a CCTV video stream for output to an external CCTV monitor, a second persistent flash memory 60 that stores the non-lethal intruder deterrent and suppression device control program as well as configuration settings for each device in the pod of components (i.e., the dazzler, the camera, and the spray nozzles). The non-lethal intruder deterrent and suppression device control program and the configuration settings for each device in the pod of components are loaded into the RAM 52 and executed by the code execution unit 56 of the MCU 54 to provide user access and operation of the non-lethal intruder deterrent and suppression device, and to automatically capture the incoming video stream from the HD camera, convert the HD video to a CCTV stream, and output to an external CCTV display monitor. In some embodiments, the non-lethal intruder deterrent and suppression device control program also transmits the captured video to an external storage device for archival persistent video data storage. In this way, the computing device 48 not only that manages data commands and device operation for the computer controlled internal pump and delivery system encapsulated within the control box of a non-lethal intruder deterrent and suppression device, but also acts as a store-and-forward video content device.

In some embodiments, the computing device 48 also includes radio (RF) hardware 62 for transmission of data, including the video data prepared for persistent storage and transmitted to the external video storage devices or systems. The RF hardware 62 may include wireless data devices, such as cellular, CDMA, or other mobile telephonic signal protocols, WiFi or Bluetooth transmitters, GPS devices, Zigbee devices, or other such wireless data chips or devices.

In some embodiments, the computing device 48 also includes an input/output (I/O) port management unit 64. The I/O port management unit 64 is configured to manage input and output between the computing device 48 and the various pod components, namely, the camera, the light ring (or dazzler), and the spray nozzles. Specifically, the I/O port management unit 64 is configured to send command signals to the camera, the light ring (dazzler), and the spray nozzles according to input received through the radio (RF) hardware 62 from an operator device or direct input from motion detection devices (when so configured). For example, an operator sends a command to pivot the camera right or left or tilt the camera up or down, or the operator sends a command to start capturing video in the target area, and also to shine the high intensity light around the light ring and spray the non-lethal formula through the spray nozzles in the direction of the unwanted intruder. When the non-lethal intruder deterrent and suppression device includes a sound wave generating audio device ("sound wave generator"), the operator may send a command to audibly and loudly generate a sound wave that temporarily incapacitates an unwanted intruder. Furthermore, the non-lethal intruder deterrent and suppression device control program may be configured to automate certain commands based on input received from one or more motion detection devices. Specifically, the configuration settings may indicate that the camera, the light ring, and the spray nozzles should automatically be started by the non-lethal intruder deterrent and suppression device control program when the motion detection devices detect a threshold amount of movement in a target area. Thus, in some embodiments, the I/O port management unit 64 is also configured to manage input from one or more motion detection sensors positioned on or proximate to the non-lethal intruder deterrent and suppression device. In some embodiments, the I/O port management unit 64 is further configured to send a signal to the sound wave generator to sound an immediate alarm when an unwanted intruder is detected.

In some embodiments, the computing device 48 for the non-lethal intruder deterrent and suppression device also includes an encryption software implementation module 66 that stores one or more encryption standards or encryption software programs that implement one or more encryption algorithms or protocols. Examples of encryption algorithms or protocols supported by embodiments of the non-lethal intruder deterrent and suppression device include, without limitation, SHA256, SHA512, SHA-3, AES-256, AES-512, and other highly secure encryption standards. In some embodiments, the non-lethal intruder deterrent and suppression device control program encrypts all video data captured and prepared for transmission to external persistent storage. In some embodiments, the non-lethal intruder deterrent and suppression device control program encrypts the video data by loading one or more of the supported encryption standards or encryption software programs from the encryption software implementation module 66 into the RAM 52 to provide runtime access to the code execution unit 56 of the MCU 54 when converting a captured HD video to an encrypted CCTV stream or when storing the captured video to external video storage.

In some embodiments, the non-lethal intruder deterrent and suppression device control program further includes an artificial intelligence (AI) recognition capability (or software) that is invoked by facial recognition software and/or weapon recognition software to alert the defender of greater risk. In some embodiments, the AI recognition software, the facial recognition software, and/or the weapon recognition software is embedded within the non-lethal intruder deterrent and suppression device control program. In some embodiments, the AI recognition software, the facial recognition software, and/or the weapon recognition software is called externally by the non-lethal intruder deterrent and suppression device control program. For example, the non-lethal intruder deterrent and suppression device control program may invoke this by calling an AI cloud service or module, or a facial recognition software application service/weapon recognition software application service over the Internet (to a cloud application service that provides facial recognition and/or weapon recognition cloud services). Additionally, the non-lethal intruder deterrent and suppression device of some embodiments also includes an automatic deployment capability based on risk factors identified and confirmed by the AI recognition software.

In this specification, the term "software" is meant to include firmware residing in read-only memory or applications stored in magnetic storage, which can be read into memory for processing by a processor. Many of the above-described features and applications are implemented as software processes that are specified as a set of instructions recorded on a computer readable storage medium (also referred to as computer readable medium or machine readable medium), such as when an operator (or "user") is remotely interacting with a non-lethal intruder deterrent and suppression device by way of a computing device and software interface that is communicably connected to the non-lethal intruder deterrent and suppression device (e.g., by a wireless connection to the radio (RF) hardware 62). When these instructions are executed by one or more processing unit(s) (e.g., one or more processors, cores of processors, or other processing units), they cause the processing unit(s) to perform the actions indicated in the instructions. As such, the user can interact with the non-lethal intruder deterrent and suppression device through any remote device, enabling commands to be sent from any location to a specific non-lethal intruder deterrent and suppression device, or to multiple, logically grouped non-lethal intruder deterrent and suppression devices, by user specification of commands through such software. Examples of computer readable media include, but are not limited to, CD-ROMs, flash drives, RAM chips, hard drives, EPROMs, etc. The computer readable media does not include carrier waves and electronic signals passing wirelessly or over wired connections.

Also, in this specification, the term "video" may or may not also include audio recording capabilities.

FIG. 9 conceptually illustrates an electronic system 68 with which some users are enabled to interact with one or more non-lethal intruder deterrent and suppression device (s). The electronic system 68 may be a computer, a mobile computing device, a tablet computing device, a smartphone, a web server, a cloud server that hosts a cloud application service for access to connecting mobile devices or other computing devices operated by the user to interact with one or more non-lethal intruder deterrent and suppression device (s), either locally or remotely (or both locally and remotely for multiple, distributed non-lethal intruder deterrent and suppression devices), and associated database management system devices, such as may communicably connect to cloud database storages for persistent encrypted video storage of HD video captured by each non-lethal intruder deterrent and suppression device in a secure, encrypted, and fail-safe manner. Such an electronic system includes several types of computer readable media and interfaces for various other types of computer readable media. Thus, as a computing device that provides an interface for interacting with a non-lethal intruder deterrent and suppression device, the electronic system 68 includes a bus 70, a processor 72 (or multiple processing unit(s) 72), a system memory 74, a read-only memory 76, a permanent storage device 78, input devices 80, output devices 82, and a network 84.

The bus 70 collectively represents all system, peripheral, and chipset buses that communicatively connect the numerous internal devices of the electronic system 68. For instance, the bus 70 communicatively connects the processing unit(s) 72 with the read-only memory 76, the system memory 74, and the permanent storage device 78. Similarly, where the electronic system 68 implements a software interface for user to interact with a cloud application service, the bus 70 may communicatively connect the network 84 to a cloud server which hosts the cloud application service and provides session management and configuration data which the read-only memory 76 stores in registers at runtime for the duration of the session.

From these various memory units, the processing unit(s) 72 retrieves instructions to execute and data to process in order to execute the processes for enabling a user to interface with one or more non-lethal intruder deterrent and suppression device(s), and thereby control, configure, check status, or otherwise operate the non-lethal intruder deterrent and suppression device(s). In some embodiments, the user is an automated processor of a cloud application service that automatically controls, configures, checks status, or otherwise interacts with and operates one or more non-lethal intruder deterrent and suppression device(s). For example, the automated user may be a process running on a cloud server deployment of the present electronic system 68 or a local computing device deployment of the electronic system 68, either of which may rely on data from one or more motion detector devices to efficiently operate the non-lethal intruder deterrent and suppression device(s) in an automated manner. The processing unit(s) may be a single processor 72 or a multi-core processor 72 in different embodiments.

The read-only-memory (ROM) 76 stores static data and instructions that are needed by the processing unit(s) 72 and other modules of the electronic system 68. The permanent storage device 78, on the other hand, is a read-and-write memory device. This device is a non-volatile memory unit that stores instructions and data even when the electronic system 68 is off. Some embodiments of the non-lethal intruder deterrent and suppression device use a mass-storage device (such as a video storage device) as the permanent storage device 78, which the electronic system 68 may utilize.

Other embodiments use a removable storage device (such as a flash drive or a solid state device hard drive disk) as the permanent storage device 78. Like the permanent storage device 78, the system memory 74 is a read-and-write memory device. However, unlike storage device 78, the system memory 74 is a volatile read-and-write memory, such as a random access memory. The system memory 74 stores some of the instructions and data that the processor needs at runtime to allow for user or automated interaction with one or more non-lethal intruder deterrent and suppression device(s). In some embodiments, processes for displaying user interfaces in human-understandable, visual terms, are stored in the system memory 74, the permanent storage device 78, and/or the read-only memory 76. From these various memory units, the processing unit(s) 72 retrieves instructions to execute and data to process in order to execute the processes for interacting with the non-lethal intruder deterrent and suppression device(s) of some embodiments.

The bus 70 also connects to the input and output devices 80 and 82. The input devices enable the user to communicate information and select commands to the electronic system. The input devices 80 include alphanumeric keyboards and pointing devices (also called "cursor control devices"). The output devices 82 display images generated by the electronic system 68. The output devices 82 include printers and display devices, such as a liquid crystal display (LCD) or an organic light emitting diode (OLED) display. Some embodiments include input/output devices such as a touchscreen, which functions as both an input device and an output device, allowing a human user to make touch gesture contact with the touchscreen to interact with one or more of the networks or locally connected non-lethal intruder deterrent and suppression device(s).

Finally, as shown in FIG. 9, the bus 70 also couples electronic system 68 to the network 84 through a network adapter (not shown). In this manner, the computer can be a part of a network of computers (such as a local area network ("LAN"), a wide area network ("WAN"), or an intranet), or a network of networks (such as the Internet). Any or all components of electronic system 68 may be used in this remote, network-accessible manner to interact with and operate, configure, control, or otherwise check status of operation of one or more non-lethal intruder deterrent and suppression device(s).

These functions described above can be implemented in digital electronic circuitry, in computer software, firmware or hardware. The techniques can be implemented using one or more computer program products. Programmable processors and computers can be packaged or included in mobile devices. The processes may be performed by one or more programmable processors and by one or more set of programmable logic circuitry. General and special purpose computing and storage devices can be interconnected through communication networks. Some embodiments include electronic components, such as microprocessors, storage and memory that store computer program instructions in a machine-readable or computer-readable medium (alternatively referred to as computer-readable storage media, machine-readable media, or machine-readable storage media). The computer-readable media may store a program that is executable by a processing unit and includes sets of instructions for performing various operations. Examples of programs or computer code include machine code, such as is produced by a compiler, and files including higher-level code that are executed by a computer, an electronic component, or a microprocessor using an interpreter.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A non-lethal intruder deterrent and suppression device capable of temporary incapacitation comprising:

a rectangular box housing mounted to one of a ceiling and a wall;

a computer controlled internal pump and delivery system that is encased within the rectangular box housing, said computer controlled internal pump and delivery system comprising a computing device and a fluid pump;

a high intensity light of at least 2,500 lumens brightness that renders a visual disturbance to an unwanted intruder when turned on in a direction facing the unwanted intruder;

a nozzle attached to a hose which delivers a proprietary spray agent to spray out the nozzle when aimed at a pre-set target area in which an unwanted intruder is likely to enter and exit;

a tank with the proprietary spray agent that the fluid pump pumps through the hose and out the nozzle;

a high definition camera that is configured to record video of the pre-set target area; and a power toggle button which when turned on activates the non-lethal intruder deterrent and suppression device and allows the user to selectively choose whether to spray the proprietary spray agent and shine the high intensity strobe light in the direction of the pre-set target area when an unwanted intruder is in the pre-set target area and poses a danger to the user and the premises;

wherein the high definition camera comprises an embedded audio recording component that is configured to record audio along with the video, wherein the high intensity light, the high definition camera with embedded audio recording component, and the nozzle are encapsulated within a pod case that is communicably connected to the computing device of the computer controlled internal pump and delivery system within the rectangular box housing.

2. The non-lethal intruder deterrent and suppression device capable of temporary incapacitation of claim 1, wherein the high intensity light comprises a strobe light.

3. The non-lethal intruder deterrent and suppression device capable of temporary incapacitation of claim 1, wherein the pod case is configured to pivot and tilt.

4. The non-lethal intruder deterrent and suppression device capable of temporary incapacitation of claim 3, wherein the rectangular box housing is mounted above the ceiling and the pod case is communicably connected to the computing device of the computer controlled internal pump and delivery system within the rectangular box housing mounted above the ceiling by an extension arm that extends below the ceiling.

5. The non-lethal intruder deterrent and suppression device capable of temporary incapacitation of claim 1, wherein the recorded video is transmitted over a CCTV line to a CCTV display monitor.

6. The non-lethal intruder deterrent and suppression device capable of temporary incapacitation of claim 1, wherein the high definition camera is a night vision camera that captures visible video when recording the pre-set target area in darkness.

7. The non-lethal intruder deterrent and suppression device capable of temporary incapacitation of claim 1, wherein the high definition camera is an infrared camera that provides thermal imaging with thermal temperature readout.

8. The non-lethal intruder deterrent and suppression device capable of temporary incapacitation of claim 1 further comprise a motion detection sensor that detects movement in the pre-set target area.

9. The non-lethal intruder deterrent and suppression device capable of temporary incapacitation of claim 8, wherein the motion detection sensor automatically activates the high definition camera to record the detected movement in the pre-set target area and alert an operator of a possible unwanted intruder.

* * * * *